US008403531B2

(12) United States Patent
Negley et al.

(10) Patent No.: US 8,403,531 B2
(45) Date of Patent: Mar. 26, 2013

(54) LIGHTING DEVICE AND METHOD OF LIGHTING

(75) Inventors: Gerald H. Negley, Durham, NC (US); Antony Paul Van De Ven, Sai Kung (HK); Thomas G. Coleman, Pittsboro, NC (US); Mark D. Edmond, Raleigh, NC (US)

(73) Assignee: Cree, Inc., Durham, NC (US)

( * ) Notice: Subject to any disclaimer, the term of this patent is extended or adjusted under 35 U.S.C. 154(b) by 974 days.

(21) Appl. No.: 12/277,745

(22) Filed: Nov. 25, 2008

(65) Prior Publication Data

US 2009/0161356 A1 Jun. 25, 2009

Related U.S. Application Data

(63) Continuation-in-part of application No. 11/755,153, filed on May 30, 2007.

(60) Provisional application No. 60/990,439, filed on Nov. 27, 2007, provisional application No. 60/990,435, filed on Nov. 27, 2007.

(51) Int. Cl.
*F21V 33/00* (2006.01)

(52) U.S. Cl. ..... 362/249.02; 362/800

(58) Field of Classification Search ..... 362/800, 362/249.02, 311.02

See application file for complete search history.

(56) References Cited

U.S. PATENT DOCUMENTS

| | | | | |
|---|---|---|---|---|
| 6,252,254 | B1 | 6/2001 | Soules et al. | |
| 6,429,583 | B1 | 8/2002 | Levinson et al. | |
| 6,522,065 | B1 | 2/2003 | Srivastava et al. | |
| 7,061,454 | B2 | 6/2006 | Sasuga et al. | |
| 7,144,121 | B2 | 12/2006 | Minano et al. | |
| 7,213,940 | B1 | 5/2007 | Van De Ven et al. | |
| 7,365,485 | B2 | 4/2008 | Fukasawa et al. | |
| 2004/0105264 | A1 | 6/2004 | Spero | |
| 2007/0115670 | A1* | 5/2007 | Roberts et al. | 362/367 |
| 2007/0115671 | A1* | 5/2007 | Roberts et al. | 362/367 |
| 2007/0223219 | A1 | 9/2007 | Medendorp et al. | |

OTHER PUBLICATIONS

U.S. Appl. No. 11/613,692, filed Dec. 20, 2006.
U.S. Appl. No. 11/614,180, filed Dec. 21, 2006.
U.S. Appl. No. 11/613,714, filed Dec. 20, 2006.
U.S. Appl. No. 11/613,733, filed Dec. 20, 2006.
U.S. Appl. No. 11/624,811, filed Jan. 19, 2007.
U.S. Appl. No. 11/626,483, filed Jan. 24, 2007.
U.S. Appl. No. 11/743,754, filed May 3, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/736,761, filed Apr. 18, 2007.
U.S. Appl. No. 11/736,799, filed Apr. 18, 2007.
U.S. Appl. No. 11/737,321, filed Apr. 19, 2007.
U.S. Appl. No. 11/755,149, filed May 30, 2007.
U.S. Appl. No. 11/755,162, filed May 30, 2007.
U.S. Appl. No. 11/856,421, filed Sep. 17, 2007.
U.S. Appl. No. 11/859,048, filed Sep. 21, 2007.
U.S. Appl. No. 11/936,163, filed Nov. 7, 2007.
U.S. Appl. No. 11/843,243, filed Aug. 22, 2007.
U.S. Appl. No. 11/948,021, filed Nov. 30, 2007.
U.S. Appl. No. 11/870,679, filed Oct. 11, 2007.
U.S. Appl. No. 11/951,626, filed Dec. 6, 2007.

(Continued)

*Primary Examiner* — Laura Tso
(74) *Attorney, Agent, or Firm* — Burr & Brown

(57) ABSTRACT

There is provided a lighting device which emits light with an wall plug efficiency of at least 85 lumens per watt. The lighting device comprises at least one solid state light emitter, e.g., one or more light emitting diodes, and optionally further includes one or more luminescent material. In some embodiments, the output light is of a brightness of at least 300 lumens. In some embodiments, the output light has a CRI Ra of at least 90. Also, a method of lighting, comprising supplying electricity to a lighting device which emits light with a wall plug efficiency of at least 85 lumens per watt.

26 Claims, 6 Drawing Sheets

OTHER PUBLICATIONS

U.S. Appl. No. 12/035,604, filed Feb. 22, 2008.
U.S. Appl. No. 12/117,122, filed May 8, 2008.
U.S. Appl. No. 12/117,131, filed May 8, 2008.
U.S. Appl. No. 12/117,136, filed May 8, 2008.
U.S. Appl. No. 11/947,323, filed Nov. 29, 2007.
U.S. Appl. No. 12/117,148, filed May 8, 2008.
U.S. Appl. No. 12/117,271, filed May 8, 2008.
U.S. Appl. No. 11/755,153, filed May 30, 2007.
U.S. Appl. No. 12/057,748, filed Mar. 28, 2008.
U.S. Appl. No. 11/743,324, filed May 2, 2007.
U.S. Appl. No. 11/689,614, filed Mar. 22, 2007.
U.S. Appl. No. 11/112,429, filed Apr. 22, 2005.
U.S. Appl. No. 11/227,667, filed Sep. 15, 2005.
U.S. Appl. No. 12/248,220, filed Oct. 9, 2008.
Van de Ven et al., "Warm White Illumination with High CRI and High Efficacy by Combining 455 nm Excited Yellowish Phosphor LEDs and Red AlInGaP LEDs", First International Conference on White LEDs and Solid State Lighting.
Shimizu, "Development of High-Efficiency LED Downlight", First International Conference on White LEDs and Solid State Lighting.
Press Release from LED Lighting Fixtures dated Jan. 26, 2006 entitled "LED Lighting Fixtures Creates 750 Lumen Recessed Light and Uses Only 16 Watts of Power".
Press Release from LED Lighting Fixtures dated Feb. 16, 2006 entitled "LED Lighting Fixtures, Inc. Announces Record Performance".
Press Release from LED Lighting Fixtures dated Apr. 24, 2006 entitled "LED Lighting Fixtures, Inc. achieves unprecedented gain in light output from new luminaire".
Press Release from LED Lighting Fixtures dated Feb. 7, 2007 entitled "LED Lighting Fixtures Announces its First LED-based Recessed Down Light".
Press Release from LED Lighting Fixtures dated May 4, 2007 entitled "LED Lighting Fixtures to Expand Product Line".
Press Release from LED Lighting Fixtures dated Nov. 28, 2007 entitled "New Lamp from LED Lighting Fixtures Shatters World Record for Energy Efficiency".
Press Release from LED Lighting Fixtures dated May 30, 2006 entitled "LED Lighting Fixtures, Inc. Sets World Record at 80 Lumens per Watt for Warm White Fixture".
CSA International, "Test Data Report", Project No. 1786317, Report No. 1786317-1 (Apr. 2006).
Compound Semiconductors Online, "LED Lighting Fixtures, Inc. Sets World Record at 80 Lumens per Watt for Warm White".
DOE SSL CALiPer Report, "Product Test Reference: CALiPER 07-31 Downlight Lamp".
DOE SSL CALiPer Report, "Product Test Reference: CALiPER 07-47 Downlight Lamp".
U.S. Department of Energy, "DOE Solid-State Lighting CALiPER Program, Summary of Results: Round 3 of Product Testing", Oct. 2007.
U.S. Department of Energy, "DOE Solid-State Lighting CALiPER Program, Summary of Results: Round 4 of Product Testing", Jan. 2008.
U.S. Department of Energy, "DOE Solid-State Lighting CALiPER Program, Summary of Results: Round 5 of Product Testing", May 2008.

* cited by examiner

LIGHTING DEVICE AND METHOD OF LIGHTING

CROSS-REFERENCE TO RELATED APPLICATIONS

This application claims the benefit of U.S. Provisional Patent Application No. 60/990,439, filed on Nov. 27, 2007, entitled "HIGH EFFICIENCY LAMP" (inventors: Gerald H. Negley and Antony Paul van de Ven), the entirety of which is hereby incorporated by reference as if set forth in its entirety.

This application claims the benefit of U.S. Provisional Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference as if set forth in its entirety.

This application is also a continuation-in-part of U.S. patent application Ser. No. 11/755,153, filed May 30, 2007 (now U.S. Patent Publication No. 2007/0279903), the entirety of which is incorporated herein by reference.

FIELD OF THE INVENTIVE SUBJECT MATTER

The present inventive subject matter is directed to a lighting device, in particular, a lighting device which includes at least one solid state light emitter which provides excellent wall plug efficiency. The present inventive subject matter is also directed to a method of lighting which provides excellent wall plug efficiency, in particular, a method of lighting which includes supplying current to a solid state light emitter.

BACKGROUND OF THE INVENTIVE SUBJECT MATTER

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient as compared to solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction.

Color reproduction is typically measured using the Color Rendering Index (CRI Ra). CRI Ra is a modified average of the relative measurement of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80).

Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, wall plug efficiency (lm/W), and/or duration of service.

A variety of solid state light emitters are well-known. For example, one type of solid state light emitter is a light emitting diode.

Light emitting diodes are semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI Ra).

Because light that is perceived as white is necessarily a blend of light of two or more colors (or wavelengths), no single light emitting diode junction has been developed that can produce white light efficiently. "White" LED lamps have been produced which have a light emitting diode pixel/cluster formed of respective red, green and blue light emitting diodes. Another "white" LED lamp which has been produced includes (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of primary colors.

The CRI Ra of efficient white LED lamps is generally low (in the range 65-75) as compared to incandescent light sources (CRI Ra of 100). Additionally, the color temperature for LEDs is generally "cooler" (~5500K) and less desirable than the color temperature of incandescent or CCFL bulbs (~2700K). Both of these deficiencies in LEDs can be improved by the addition of other LEDs and/or luminescent material(s) of selected saturated colors. As indicated above, light sources according to the present inventive subject matter can utilize specific color "blending" of light sources of specific (x,y) color chromaticity coordinates (U.S. Patent Application No. 60/752,555, filed Dec. 21, 2005, entitled "LIGHTING DEVICE AND LIGHTING METHOD" (inventors: Antony Paul Van de Ven and Gerald H. Negley) and U.S. patent application Ser. No. 11/613,714, filed Dec. 20, 2006 (now U.S. Patent Publication No. 2007/0139920), the entireties of which are hereby incorporated by reference as if set forth in their entireties). For example, light from additional selected saturated sources can be mixed with the unsaturated broad spectrum source(s) to provide uniform illumination without any areas of discoloration; and if desired, for cosmetic reasons, the individual light emitters can be made to be not visible as discreet devices or discreet color areas when the illumination source or aperture is viewed directly.

Light emitting diodes can thus be used individually or in any combinations, optionally together with one or more luminescent material (e.g., phosphors or scintillators) and/or filters, to generate light of any desired perceived color (including white). Accordingly, the areas in which efforts are being made to replace existing light sources with light emitting diode light sources, e.g., to improve energy efficiency, color rendering index (CRI Ra), wall plug efficiency (lm/W), and/or duration of service, are not limited to any particular color or color blends of light.

Aspects related to the present inventive subject matter can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

The chromaticity coordinates and the CIE chromaticity diagrams are explained in detail in a number of books and other publications, such as pages 98-107 of K. H. Butler, "Fluorescent Lamp Phosphors" (The Pennsylvania State University Press 1980) and pages 109-110 of G. Blasse et al., "Luminescent Materials" (Springer-Verlag 1994), both incorporated herein by reference.

The chromaticity coordinates (i.e., color points) that lie along the blackbody locus obey Planck's equation: $E(\lambda)=A\lambda^{-5}/(e^{(B/T)}-1)$, where E is the emission intensity, $\lambda$ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

Also depicted on the 1976 CIE Diagram are designations A, B, C, D and E, which refer to light produced by several standard illuminants correspondingly identified as illuminants A, B, C, D and E, respectively.

A wide variety of luminescent materials (also known as lumiphors or luminophoric media, e.g., as disclosed in U.S.

Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear or substantially transparent encapsulant material (e.g., epoxy-based, silicone-based, glass-based or metal oxide-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, "white LED lights" (i.e., lights which are perceived as being white or near-white) have been investigated as potential replacements for white incandescent lamps. A representative example of a white LED lamp includes a package of a blue light emitting diode chip, made of indium gallium nitride (InGaN) or gallium nitride (GaN), coated with a phosphor such as YAG. In such an LED lamp, the blue light emitting diode chip produces an emission with a peak wavelength of about 450 nm, and the phosphor produces yellow fluorescence with a peak wavelength of about 550 nm on receiving that emission. For instance, in some designs, white light emitting diode lamps are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light. Another type uses a blue or violet light emitting diode chip which is combined with phosphor materials that produce red or orange and green or yellowish-green light rays. In such a lamp, part of the blue or violet light emitted by the light emitting diode chip excites the phosphors, causing the phosphors to emit red or orange and yellow or green light rays. These rays, combined with the blue or violet rays, can produce the perception of white light.

As also noted above, in another type of LED lamp, a light emitting diode chip that emits an ultraviolet ray is combined with phosphor materials that produce red (R), green (G) and blue (B) light rays. In such an LED lamp, the ultraviolet ray that has been radiated from the light emitting diode chip excites the phosphor, causing the phosphor to emit red, green and blue light rays which, when mixed, are perceived by the human eye as white light. Consequently, white light can also be obtained as a mixture of these light rays.

In substituting light emitting diodes for other light sources, e.g., incandescent light bulbs, packaged LEDs have been used with conventional light fixtures, for example, fixtures which include a hollow lens and a base plate attached to the lens, the base plate having a conventional socket housing with one or more contacts which is electrically coupled to a power source. For example, LED light bulbs have been constructed which comprise an electrical circuit board, a plurality of packaged LEDs mounted to the circuit board, and a connection post attached to the circuit board and adapted to be connected to the socket housing of the light fixture, whereby the plurality of LEDs can be illuminated by the power source.

There exist "white" LED light sources which are relatively efficient but which have poor color rendering, typically having CRI Ra values of less than 75, and which are particularity deficient in the rendering of red colors and also to a significant extent deficient in green. This means that many things, including the typical human complexion, food items, labeling, painting, posters, signs, apparel, home decoration, plants, flowers, automobiles, etc. exhibit odd or wrong color as compared to being illuminated with an incandescent light or natural daylight. Typically, such white LED lamps have a color temperature of approximately 5000K, which is generally not visually comfortable for general illumination, which may, however, be desirable for the illumination of commercial produce or advertising and printed materials.

Colored objects illuminated by RGB LED lamps sometimes do not appear in their true colors. For example, an object that reflects only yellow light, and thus that appears to be yellow when illuminated with white light, may appear desaturated and grayish when illuminated with light having an apparent yellow color, produced by the red and green LEDs of an RGB LED fixture. Such lamps, therefore, are considered not to provide excellent color rendition, particularly when illuminating various settings such as in general illumination, and particularly with regard to natural sources. In addition, currently available green LEDs are relatively inefficient, and thus limit the efficiency of such lamps.

Some so-called "warm white" LEDs have a more acceptable color temperature (typically 2700 to 3500 K) for indoor use, and in some cases, many (but not all) of such warm white LEDs have good CRI Ra (in the case of a yellow and red phosphor mix, as high as Ra=95), but their efficacy is generally significantly less than that of the standard "cool white" LEDs.

Employing LEDs having a wide variety of hues would similarly necessitate use of LEDs having a variety of efficiencies, including some with low efficiency, thereby reducing the efficiency of such systems and dramatically increasing the complexity and cost of the circuitry to control the many different types of LEDs and maintain the color balance of the light.

There is therefore a need for a high efficiency solid-state white light source that combines the efficiency and long life of white LED lamps with an acceptable color temperature and good color rendering index, good contrast, a wide gamut and simple control circuitry.

In the case of conventional LED packages which include a phosphor, a significant proportion (e.g., in many cases, as much as 20% to 25%) of the excitation light (i.e., light from the LED) is reflected (back-scattered) from the phosphor back into the light emitting diode chip/package. Back-scattered light which is scattered back into the light emitting diode chip itself has a very low probability of coming out of the chip, and hence, such back-scattering results in a system loss of energy.

In addition, the phosphor converted light is omnidirectional, so that in general, 50% of the light is directed back to the LED source.

Furthermore, if the luminescent element is too thick, and/or if the luminescent material (e.g., phosphor) content in the luminescent element is too great, "self-absorption" may occur. Self-absorption occurs when light emissions within the packaging layer stay within the packaging layer to excite other phosphor particles and eventually are absorbed or are otherwise prevented from exiting the device, thus reducing performance (intensity) and efficiency. Additionally, if the particle size of the luminescent material (e.g., phosphors) is too large, the particles of luminescent material can cause unwanted scattering of both the excitation source (the LED chip) and the light generated by the phosphor.

There is an ongoing need for ways to use light emitting diodes in a wider variety of applications, with greater energy efficiency, with improved color rendering index (CRI Ra), with improved wall plug efficiency (lm/W), lower cost, and/or with longer duration of service.

BRIEF SUMMARY OF THE INVENTIVE SUBJECT MATTER

In a first aspect of the present inventive subject matter, there is provided a lighting device comprising at least one solid state light emitter which, when supplied with electricity of a first wattage, emits output light of a brightness of at least 85 lumens per watt of the electricity.

In a second aspect of the present inventive subject matter, there is provided a method of lighting, comprising supplying a lighting device with electricity of a first wattage, the lighting device emitting output light of a wall plug efficiency of at least 85 lumens per watt of the electricity.

In some embodiments according to the present inventive subject matter, the lighting device is a replacement lamp, i.e., it can be used to replace an original lamp contained in a fixture. For example, the present inventive subject matter includes lighting devices as described herein which can be employed in a PAR 38 light, or other known lighting designs as defined by ANSI or elsewhere.

In some embodiments according to the present inventive subject matter, the output light is of a brightness of at least 300 lumens.

In some embodiments according to the present inventive subject matter, the output light is perceived as white.

In some embodiments according to the present inventive subject matter, the output light is perceived as non-white.

In some embodiments according to the present inventive subject matter, the output light has a CRI Ra of at least 90.

In some embodiments according to the present inventive subject matter, the lighting device, when supplied with electricity of a first wattage, emits output light of a brightness of at least 110 lumens per watt of the electricity.

In some embodiments according to the fourth aspect of the present inventive subject matter, the lighting device, when supplied with electricity of a first wattage, emits output light of a brightness of 85-113.5 lumens/watt (in some cases, 100-113.5 lumens/watt) of the electricity.

In some embodiments according to the present inventive subject matter, the solid state light emitter is a first light emitting diode. In some such embodiments, the lighting device comprises a plurality of light emitting diodes, including the first light emitting diode.

In some embodiments according to the present inventive subject matter, the lighting device further comprises one or more luminescent material. In some such embodiments, at least some of the luminescent material (and in some embodiments, substantially all of it) is positioned within about 750 micrometers of at least one of the light emitting diodes.

In some embodiments according to the present inventive subject matter, the lighting device further comprises at least one power line, and at least a first group of light emitting diodes are directly or switchably electrically connected to the power line, a voltage drop across the first group of the light emitting diodes, and across any other components along that power line, being between 1.3 and 1.5 times (e.g., between 1.410 and 1.420 times) a standard outlet voltage (e.g., a standard outlet voltage of 110 volts AC). In some such embodiments, the light emitting diodes in the first group of light emitting diodes are arranged in series along the power line.

In some embodiments according to the first aspect of the present inventive subject matter, the light emitting diodes in the first group of light emitting diodes are arranged in series along a power line.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
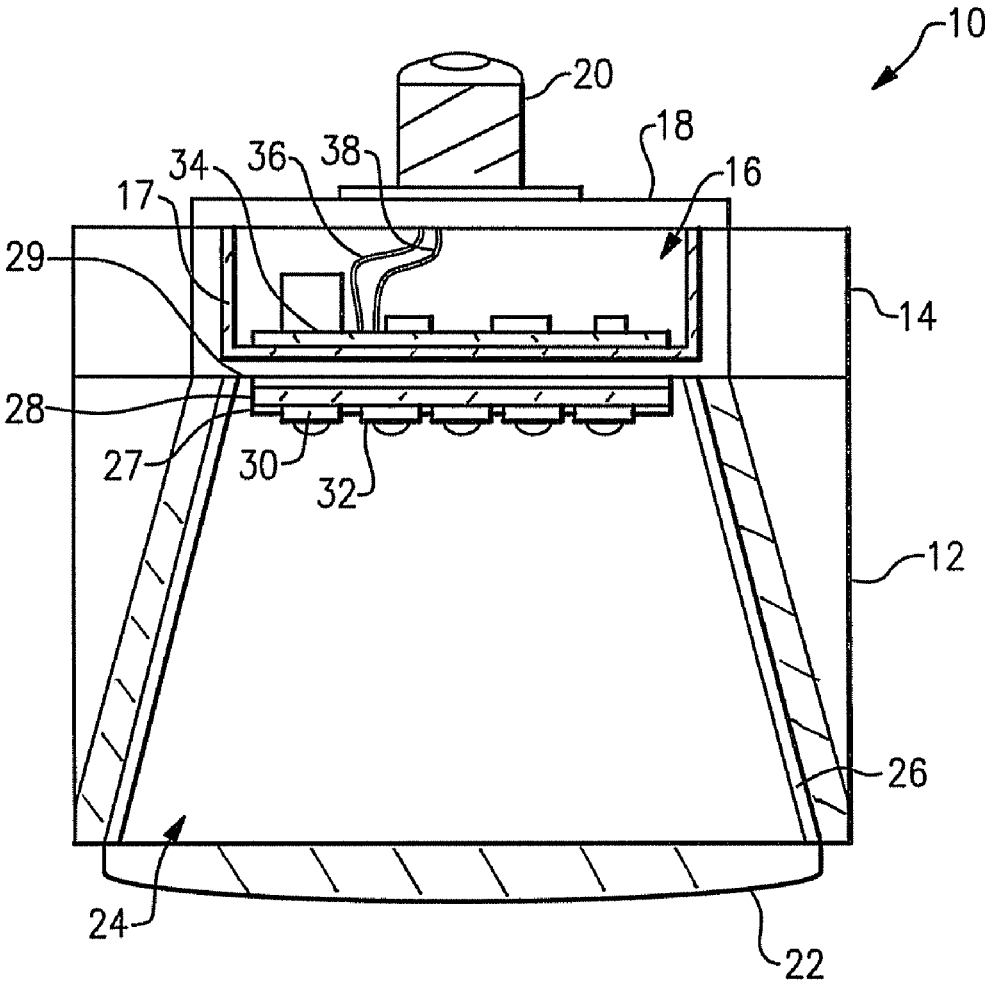
FIG. 1 is a sectional view of a specific embodiment of a lighting device according to the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As noted above, in a first aspect of the present inventive subject matter, there is provided a lighting device comprising at least one solid state light emitter which, when supplied with electricity of a first wattage, emits output light of a brightness of at least 85 lumens per watt of the electricity. In some embodiments of the first aspect of the present inventive subject matter, the output light is warm white.

As used herein, the term "wall plug efficiency" refers to the ratio of lumens delivered by the lamp to the watts of input power from a power source to which the lamp is connected and includes losses for any power supply and optical losses of the lamp. Thus, lumens reflected in wall plug efficiencies described herein are "delivered lumens" and power is total input power.

Accordingly, "wall plug efficiency," as the expression is used herein, accounts for (1) losses generated in initially converting input energy into light, (2) quantum losses, i.e., the ratio of the number of photons emitted by a luminescent material divided by the number of photons absorbed by the luminescent material, (3) Stokes losses, i.e., losses due to the change in frequency involved in the absorption of light and the emission of light, (4) optical losses involved in the light emitted by the phosphor actually exiting the lighting device and (5) any losses from converting input energy, e.g., from AC to DC. Wall plug efficiency does not equate to efficacy values for individual components and/or assemblies of components, e.g., light delivered by an LED divided by the power consumed by the LED.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

As used herein, the term "substantially" means at least about 90% correspondence with the feature recited. For example, the expression "substantially transparent", as used herein, means that the structure which is characterized as being substantially transparent allows passage of at least 90% of the light having a wavelength within the range of concern. The expression "substantially evenly" means that the spacing between any two items differs by not more than 10% from the average spacing between adjacent pairs of such items.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

Any desired solid state light emitter or emitters can be employed in accordance with the present inventive subject matter. Persons of skill in the art are aware of, and have ready access to, a wide variety of such emitters. Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made).

The respective light emitters can be similar to one another, different from one another or any combination (i.e., there can be a plurality of solid state light emitters of one type, or one or more solid state light emitters of each of two or more types)

Representative examples of suitable LEDs are described in:

U.S. Patent Application No. 60/753,138, filed on Dec. 22, 2005, entitled "LIGHTING DEVICE" (inventor: Gerald H. Negley) and U.S. patent application Ser. No. 11/614,180, filed Dec. 21, 2006 (now U.S. Patent Publication No. 2007/0236911), the entireties of which are hereby incorporated by reference as if set forth in their entireties;

U.S. Patent Application No. 60/794,379, filed on Apr. 24, 2006, entitled "SHIFTING SPECTRAL CONTENT IN LEDS BY SPATIALLY SEPARATING LUMIPHOR FILMS" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference as if set forth in their entireties;

U.S. Patent Application No. 60/808,702, filed on May 26, 2006, entitled "LIGHTING DEVICE" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference as if set forth in their entireties;

U.S. Patent Application No. 60/808,925, filed on May 26, 2006, entitled "SOLID STATE LIGHT EMITTING DEVICE AND METHOD OF MAKING SAME" (inventors: Gerald H. Negley and Neal Hunter) and U.S. patent application Ser. No. 11/753,103, filed May 24, 2007 (now U.S. Patent Publication No. 2007/0280624), the entireties of which are hereby incorporated by reference as if set forth in their entireties;

U.S. Patent Application No. 60/802,697, filed on May 23, 2006, entitled "LIGHTING DEVICE AND METHOD OF MAKING" (inventor: Gerald H. Negley) and U.S. patent application Ser. No. 11/751,990, filed May 22, 2007 (now U.S. Patent Publication No. 2007/0274063), the entireties of which are hereby incorporated by reference as if set forth in their entireties;

U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference as if set forth in their entireties;

U.S. Patent Application No. 60/857,305, filed on Nov. 7, 2006, entitled "LIGHTING DEVICE AND LIGHTING METHOD" (inventors: Antony Paul van de Ven and Gerald H. Negley and U.S. patent application Ser. No. 11/936,163, filed Nov. 7, 2007 (now U.S. Patent Publication No. 2008/0106895), the entireties of which are hereby incorporated by reference as if set forth in their entireties;

U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/084685), the entireties of which are hereby incorporated by reference as if set forth in their entireties;

U.S. Patent Application No. 60/851,230, filed on Oct. 12, 2006, entitled "LIGHTING DEVICE AND METHOD OF MAAING SAME" (inventor: Gerald H. Negley) and U.S. patent application Ser. No. 11/870,679, filed Oct. 11, 2007 (now U.S. Patent Publication No. 2008/0089053), the entireties of which are hereby incorporated by reference as if set forth in their entireties;

U.S. Patent Application No. 60/916,608, filed on May 8, 2007, entitled "LIGHTING DEVICE AND LIGHTING METHOD" (inventors: Antony Paul van de Ven and Gerald H. Negley), and U.S. patent application Ser. No. 12/117,148, filed May 8, 2008 (now U.S. Patent Publication No. 2008/0304261), the entireties of which are hereby incorporated by reference as if set forth in their entireties; and U.S. patent application Ser. No. 12/017,676, filed on Jan. 22, 2008 (now U.S. Patent Publication No. 2009/0108269), entitled "ILLUMINATION DEVICE HAVING ONE OR MORE LUMIPHORS, AND METHODS OF FABRICATING SAME" (inventors: Gerald H. Negley and Antony Paul van de Ven), U.S. patent application Ser. No. 60/982,900, filed on Oct. 26, 2007 (inventors: Gerald H. Negley and Antony Paul van de Ven), the entireties of which are hereby incorporated by reference as if set forth in their entireties.

The lighting devices according to the present inventive subject matter can comprise any desired number of solid state emitters.

As noted above, in some embodiments according to the first aspect of the present inventive subject matter, the lighting device further comprises one or more luminescent materials.

As noted above, in some embodiments according to the present inventive subject matter, the lighting device further comprises at least one luminescent material (e.g., luminescence region or luminescent element which comprises at least one luminescent material). The expression "lumiphor", as used herein, refers to any element which includes a luminescent material.

The one or more luminescent materials, when provided, can individually be any luminescent material, a wide variety of which are known to those skilled in the art. For example, the one or more luminescent materials can be selected from among phosphors, scintillators, day glow tapes, inks which glow in the visible spectrum upon illumination with ultraviolet light, etc. The one or more luminescent materials can be down-converting or up-converting, or can include a combination of both types. For example, the first luminescent material can comprise one or more down-converting luminescent materials.

The (or each of the) one or more luminescent materials can, if desired, further comprise (or consist essentially of, or consist of) one or more highly transmissive (e.g., transparent or substantially transparent, or somewhat diffuse) binder, e.g., made of epoxy, silicone, glass, metal oxide, or any other suitable material (for example, in any given lumiphor comprising one or more binder, one or more phosphor can be dispersed within the one or more binder). In general, the thicker the lumiphor, the lower the weight percentage of the phosphor can be. Representative examples of the weight percentage of phosphor include from about 3.3 weight percent up to about 20 weight percent, although, as indicated above, depending on the overall thickness of the lumiphor, the weight percentage of the phosphor could be generally any value, e.g., from 0.1 weight percent to 100 weight percent (e.g., a lumiphor formed by subjecting pure phosphor to a hot isostatic pressing procedure).

Devices in which a luminescent material is provided can, if desired, further comprise one or more clear encapsulant (comprising, e.g., one or more silicone materials) positioned between the solid state light emitter (e.g., light emitting diode) and the luminescent material (e.g., in the form of a lumiphor).

The (or each of the) one or more luminescent materials can, independently, further comprise any of a number of well-known additives, e.g., diffusers, scatterers, tints, etc.

As noted above, in some embodiments according to the present inventive subject matter, the lighting device is a replacement lamp, i.e., it can be used to replace an original lamp contained in a fixture. The present inventive subject matter further relates to lights which comprise a fixture and a lighting device as described herein. In such lights, the fixture can be any desired fixture in which a lighting device can be positioned, a wide variety of such fixtures being known to those of skill in the art. For example, lights according to the present inventive subject matter include PAR 38 lights comprising a fixture which can accommodate a PAR 38 lamp and a lighting device according to the present inventive subject matter.

As noted above, in some embodiments according to the first aspect of the present inventive subject matter, the lighting device further comprises at least one power line, and at least a first group of light emitting diodes are directly or switchably electrically connected to the power line, a voltage drop across the first group of the light emitting diodes, and across any other components along that power line, being between about 1.2 and 1.6 times, for example between 1.3 and 1.5 times (e.g., between 1.410 and 1.420 times) a standard outlet voltage (e.g., a standard outlet voltage of 110 volts AC).

For example, where the voltage from an outlet is 110 volts AC, and a power line connects to a plurality of blue light emitting diodes and a current regulator, in series, if the current regulator has a voltage drop of 7.6 volts and each light emitting diode has a voltage drop of 2.9 volts, a suitable number of such light emitting diodes to be included on that line would be 51.

Similarly, where the voltage from an outlet is 110 volts AC, and a power line connects to a plurality of blue light emitting diodes, a plurality of red light emitting diodes and a current regulator, in series, if the current regulator has a voltage drop of 7.6 volts, each blue light emitting diode has a voltage drop of 2.9 volts, and each red light emitting diode has a voltage drop of 2.0 volts, and the ratio of blue light emitting diodes to the sum of blue light emitting diodes and red light emitting diodes is desired to be in the range of from about 0.4 to about 0.6, suitable numbers of the respective light emitting diodes to be included on that line would include 24 blue and 47 red.

In addition, one or more scattering elements (e.g., layers) can optionally be included in the lighting devices according to this aspect of the present inventive subject matter. The scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

In some embodiments according to the present inventive subject matter, one or more of the light emitting diodes can be included in a package together with one or more of the luminescent materials, e.g., one or more lumiphors can be provided in the package and spaced from the one or more light emitting diode in the package to achieve improved light extraction efficiency, as described in U.S. Patent Application No. 60/753,138, filed on Dec. 22, 2005, entitled "LIGHTING DEVICE" (inventor: Gerald H. Negley) and U.S. patent application Ser. No. 11/614,180, filed Dec. 21, 2006 (now U.S. Patent Publication No. 2007/0236911), the entireties of which are hereby incorporated by reference as if set forth in their entireties.

In some embodiments according to the present inventive subject matter, two or more lumiphors can be provided, with two or more of the lumiphors being spaced from each other, as described in U.S. Patent Application No. 60/794,379, filed on Apr. 24, 2006, entitled "SHIFTING SPECTRAL CONTENT IN LEDS BY SPATIALLY SEPARATING LUMIPHOR FILMS" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference as if set forth in their entireties.

Solid state light emitters and any luminescent materials can be selected so as to produce any desired mixtures of light.

Representative examples of suitable combinations of such components to provide desired light mixing are described in:

U.S. Patent Application No. 60/752,555, filed Dec. 21, 2005, entitled "LIGHTING DEVICE AND LIGHTING METHOD" (inventors: Antony Paul Van de Ven and Gerald H. Negley) and U.S. patent application Ser. No. 11/613,714, filed Dec. 20, 2006 (now U.S. Patent Publication No. 2007/0139920), the entireties of which are hereby incorporated by reference as if set forth in their entireties;

U.S. Patent Application No. 60/752,556, filed on Dec. 21, 2005, entitled "SIGN AND METHOD FOR LIGHTING" (inventors: Gerald H. Negley and Antony Paul van de Ven) and U.S. patent application Ser. No. 11/613,733, filed Dec. 20, 2006 (now U.S. Patent Publication No. 2007/0137074), the entireties of which are hereby incorporated by reference as if set forth in their entireties;

U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference as if set forth in their entireties;

U.S. Patent Application No. 60/793,518, filed on Apr. 20, 2006, entitled "LIGHTING DEVICE AND LIGHTING METHOD" (inventors: Gerald H. Negley and Antony Paul van de Ven) and U.S. patent application Ser. No. 11/736,799, filed Apr. 18, 2007 (now U.S. Patent Publication No. 2007/0267983), the entireties of which are hereby incorporated by reference as if set forth in their entireties;

U.S. Patent Application No. 60/793,530, filed on Apr. 20, 2006, entitled "LIGHTING DEVICE AND LIGHTING METHOD" (inventors: Gerald H. Negley and Antony Paul van de Ven) and U.S. patent application Ser. No. 11/737,321, filed Apr. 19, 2007 (now U.S. Patent Publication No. 2007/0278503), the entireties of which are hereby incorporated by reference as if set forth in their entireties;

U.S. Patent Application No. 60/857,305, filed on Nov. 7, 2006, entitled "LIGHTING DEVICE AND LIGHTING METHOD" (inventors: Antony Paul van de Ven and Gerald H. Negley and U.S. patent application Ser. No. 11/936,163, filed Nov. 7, 2007 (now U.S. Patent Publication No. 2008/0106895), the entireties of which are hereby incorporated by reference as if set forth in their entireties;

U.S. Patent Application No. 60/916,596, filed on May 8, 2007, entitled "LIGHTING DEVICE AND LIGHTING METHOD" (inventors: Antony Paul van de Ven and Gerald H. Negley), and U.S. patent application Ser. No. 12/117,122, filed May 8, 2008 (now U.S. Patent Publication No. 2008/0304260), the entireties of which are hereby incorporated by reference as if set forth in their entireties;

U.S. Patent Application No. 60/916,607, filed on May 8, 2007, entitled "LIGHTING DEVICE AND LIGHTING METHOD" (inventors: Antony Paul van de Ven and Gerald H. Negley)and U.S. patent application Ser. No. 12/117,131, filed May 8, 2008 (now U.S. Patent Publication No. 2008/0278940), the entireties of which are hereby incorporated by reference as if set forth in their entireties;

U.S. Patent Application No. 60/916,590, filed on May 8, 2007, entitled "LIGHTING DEVICE AND LIGHTING METHOD" (inventors: Antony Paul van de Ven and Gerald H. Negley), and U.S. patent application Ser. No. 12/117,136, filed May 8, 2008 (now U.S. Patent Publication No. 2008/0278928), the entireties of which are hereby incorporated by reference as if set forth in their entireties;

U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), entitled "LIGHTING DEVICE AND LIGHTING METHOD" (inventors: Antony Paul van de Ven and Gerald H. Negley), the entirety of which is hereby incorporated by reference as if set forth in its entirety;

U.S. Patent Application No. 60/978,880, filed on Oct. 10, 2007, entitled "LIGHTING DEVICE AND METHOD OF MAKING" (inventors: Antony Paul van de Ven and Gerald H. Negley) and U.S. Patent Application No. 61/037,365, filed on Mar. 18, 2008, the entireties of which are hereby incorporated by reference as if set forth in their entireties;

U.S. Patent Application No. 60/868,986, filed on Dec. 7, 2006, entitled "LIGHTING DEVICE AND LIGHTING METHOD" (inventors: Antony Paul van de Ven and Gerald H. Negley), and U.S. patent application Ser. No. 11/951,626, filed Dec. 6, 2007 (now U.S. Patent Publication No. 2008/0136313), the entireties of which are hereby incorporated by reference as if set forth in their entireties;

U.S. Patent Application No. 60/891,148, filed on Feb. 22, 2007, entitled "LIGHTING DEVICE AND METHODS OF LIGHTING, LIGHT FILTERS AND METHODS OF FILTERING LIGHT" (inventor: Antony Paul van de Ven, and U.S. patent application Ser. No., and U.S. patent application Ser. No. 12/035,604, filed on Feb. 22, 2008 (now U.S. Patent Publication No. 2008/0259589), the entireties of which are hereby incorporated by reference as if set forth in their entireties;

U.S. Patent Application No. 60/916,608, filed on May 8, 2007, entitled "LIGHTING DEVICE AND LIGHTING METHOD" (inventors: Antony Paul van de Ven and Gerald H. Negley), and U.S. patent application Ser. No. 12/117,148, filed May 8, 2008 (now U.S. Patent Publication No. 2008/0304261), the entireties of which are hereby incorporated by reference as if set forth in their entireties; and U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference as if set forth in its entirety.

The expression "perceived as white", as used herein, means that normal human vision would perceive the light (i.e., the light which is characterized as being "perceived as white") as white. Similarly, the expression "perceived as non-white", as used herein, means that normal human vision would perceive the light (i.e., the light which is characterized as being "perceived as white") as not being white (including, e.g., off-white and colors other than white). In general, light which is within four or fewer MacAdam ellipses of the blackbody locus is considered to be white light, and light which is more than four MacAdam ellipses from the blackbody locus is considered to be non-white light.

The lighting devices of the present inventive subject matter can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present inventive subject matter. The lighting devices of the present inventive subject matter can be electrically connected (or selectively connected) to any desired power source, persons of skill in the art being familiar with a variety of such power sources.

Representative examples of arrangements of lighting devices, schemes for mounting lighting devices, apparatus for supplying electricity to lighting devices, housings for lighting devices, fixtures for lighting devices and power supplies for lighting devices, all of which are suitable for the lighting devices of the present inventive subject matter, are described in:

U.S. Patent Application No. 60/752,753, filed on Dec. 21, 2005, entitled "LIGHTING DEVICE" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference as if set forth in their entireties;

U.S. Patent Application No. 60/809,959, filed on Jun. 1, 2006, entitled "LIGHTING DEVICE WITH COOLING" (inventors: Thomas G. Coleman, Gerald H. Negley and Antony Paul van de Ven) and U.S. patent application Ser. No. 11/626,483, filed Jan. 24, 2007 (now U.S. Patent Publication No. 2007/0171145), the entireties of which are hereby incorporated by reference as if set forth in their entireties;

U.S. Patent Application No. 60/798,446, filed on May 5, 2006, entitled "LIGHTING DEVICE" (inventor: Antony Paul van de Ven) and U.S. patent application Ser. No. 11/743,754, filed May 3, 2007 (now U.S. Patent Publication No. 2007/0263393), the entireties of which are hereby incorporated by reference as if set forth in their entireties;

U.S. Patent Application No. 60/809,461, filed May 31, 2006, entitled "LIGHTING DEVICE WITH COLOR CONTROL, AND METHOD OF LIGHTING" (inventor: Antony Paul van de Ven), and U.S. patent application Ser. No. 11/755,149, filed May 30, 2007 (now U.S. Patent Publication No. 2007/0278974), the entireties of which are hereby incorporated by reference as if set forth in their entireties;

U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153, filed May 30, 2007 (now U.S. Patent Publication No. 2007/0279903), the entireties of which are hereby incorporated by reference as if set forth in their entireties;

U.S. Patent Application No. 60/809,595, filed on May 31, 2006, entitled "LIGHTING DEVICE AND METHOD OF LIGHTING" (inventor: Gerald H. Negley) and U.S. patent application Ser. No. 11/755,162, filed May 30, 2007 (now U.S. Patent Publication No. 2007/0279440), the entireties of which are hereby incorporated by reference as if set forth in their entireties;

U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), and U.S. patent application Ser. No. 11/856,421, filed Sep. 17, 2007 (now U.S. Patent Publication No. 2008/0084700), the entireties of which are hereby incorporated by reference as if set forth in their entireties;

U.S. Patent Application No. 60/844,325, filed on Sep. 13, 2006, entitled "BOOST/FLYBACK POWER SUPPLY TOPOLOGY WITH LOW SIDE MOSFET CURRENT CONTROL" (inventor: Peter Jay Myers), and U.S. patent application Ser. No. 11/854,744, filed Sep. 13, 2007 (now U.S. Patent Publication No. 2008/0088248), entitled "CIRCUITRY FOR SUPPLYING ELECTRICAL POWER TO LOADS", the entireties of which are hereby incorporated by reference as if set forth in their entireties;

U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007 (now U.S. Patent Publication No. 2008/0084701), the entireties of which are hereby incorporated by reference as if set forth in their entireties;

U.S. Patent Application No. 60/858,558, filed on Nov. 13, 2006, entitled "LIGHTING DEVICE, ILLUMINATED ENCLOSURE AND LIGHTING METHODS" (inventor: Gerald H. Negley) and U.S. patent application Ser. No. 11/939,047, filed Nov. 13, 2007 (now U.S. Patent Publication No. 2008/0112183), the entireties of which are hereby incorporated by reference as if set forth in their entireties;

U.S. Patent Application No. 60/858,881, filed on Nov. 14, 2006, entitled "LIGHT ENGINE ASSEMBLIES" (inventors: Paul Kenneth Pickard and Gary David Trott) and U.S. patent application Ser. No. 11/939,052, filed Nov. 13, 2007 (now U.S. Patent Publication No. 2008/0112168), the entireties of which are hereby incorporated by reference as if set forth in their entireties;

U.S. Patent Application No. 60/859,013, filed on Nov. 14, 2006, entitled "LIGHTING ASSEMBLIES AND COMPONENTS FOR LIGHTING ASSEMBLIES" (inventors: Gary David Trott and Paul Kenneth Pickard) and U.S. patent application Ser. No. 11/939,059, filed Nov. 13, 2007 (now U.S. Patent Publication No. 2008/0112170), the entireties of which are hereby incorporated by reference as if set forth in their entireties;

U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard) and U.S. patent application Ser. No. 11/877,038, filed Oct. 23, 2007 (now U.S. Patent Publication No. 2008/0106907), the entireties of which are hereby incorporated by reference as if set forth in their entireties;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety;

U.S. Patent Application No. 60/916,384, filed on May 7, 2007, entitled "LIGHT FIXTURES, LIGHTING DEVICES, AND COMPONENTS FOR THE SAME" (inventors: Paul Kenneth Pickard, Gary David Trott and Ed Adams; and U.S. patent application Ser. No. 11/948,041, filed Nov. 30, 2007 (now U.S. Patent Publication No. 2008/0137347)(inventors: Gary David Trott, Paul Kenneth Pickard and Ed Adams), the entireties of which are hereby incorporated by reference as if set forth in their entireties;

U.S. Patent Application No. 60/916,030, filed on May 4, 2007, entitled "LIGHTING FIXTURE" (inventors: "Paul Kenneth Pickard, James Michael LAY and Gary David Trott) and U.S. patent application Ser. No. 12/114,994, filed May 5, 2008 (now U.S. Patent Publication No. 2008/0304269), the entireties of which are hereby incorporated by reference as if set forth in their entireties;

U.S. Patent Application No. 60/916,407, filed on May 7, 2007, entitled "LIGHT FIXTURES AND LIGHTING DEVICES" (inventors: Gary David Trott and Paul Kenneth Pickard), and U.S. patent application Ser. No. 12/116,341, filed May 7, 2008 (now U.S. Patent Publication No. 2008/0278952), the entireties of which are hereby incorporated by reference as if set forth in their entireties;

U.S. Patent Application No. 60/943,910, filed on Jun. 14, 2007, entitled "DEVICES AND METHODS FOR POWER CONVERSION FOR LIGHTING DEVICES WHICH INCLUDE SOLID STATE LIGHT EMITTERS" (inventor: Peter Jay Myers), and U.S. patent application Ser. No. 12/117,280, filed May 8, 2008 (now U.S. Patent Publication No. 2008/0309255), the entireties of which are hereby incorporated by reference as if set forth in their entireties;

U.S. Patent Application No. 61/022,886, filed on Jan. 23, 2008, entitled "FREQUENCY CONVERTED DIMMING SIGNAL GENERATION" (inventors: Peter Jay Myers, Michael Harris and Terry Given) and U.S. Patent Application No. 61/039,926, filed Mar. 27, 2008, the entireties of which are hereby incorporated by reference as if set forth in their entireties;

U.S. Patent Application No. 61/029,068, filed on Feb. 15, 2008, entitled "LIGHT FIXTURES AND LIGHTING DEVICES" (inventors: Paul Kenneth Pickard and Gary David Trott), U.S. Patent Application No. 61/037,366, filed on Mar. 18, 2008, and U.S. patent application Ser. No. 12/116,346, filed May 7, 2008 (now U.S. Patent Publication No. 2008/0278950), the entireties of which are hereby incorporated by reference as if set forth in their entireties;

U.S. patent application Ser. No. 12/116,348, filed on May 7, 2008 (now U.S. Patent Publication No. 2008/0278957), entitled "LIGHT FIXTURES AND LIGHTING DEVICES" (inventors: Paul Kenneth Pickard and Gary David Trott), the entirety of which is hereby incorporated by reference as if set forth in its entirety;

U.S. Patent Application No. 61/108,130, filed on Oct. 24, 2008, entitled "LIGHTING DEVICE WHICH INCLUDES ONE OR MORE SOLID STATE LIGHT EMITTING DEVICE" (inventors: Antony Paul van de Ven and Gerald H. Negley), the entirety of which is hereby incorporated by reference as if set forth in its entirety;

U.S. Patent Application No. 61/108,133, filed on Oct. 24, 2008, entitled "LIGHTING DEVICE" (inventors: Gerald H. Negley and Antony Paul van de Ven), the entirety of which is hereby incorporated by reference as if set forth in its entirety; and U.S. Patent Application No. 61/108,149, filed on Oct. 24, 2008, entitled "LIGHTING DEVICE, HEAT TRANSFER STRUCTURE AND HEAT TRANSFER ELEMENT" (inventors: Antony Paul van de Ven and Gerald H. Negley), the entirety of which is hereby incorporated by reference as if set forth in its entirety.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosure (uniformly or non-uniformly).

The present inventive subject matter further relates to an illuminated surface, comprising a surface and at least one lighting device according to the present inventive subject matter, wherein the lighting device illuminates at least a portion of the surface.

The present inventive subject matter further relates to an illuminated area, comprising at least one area selected from among the group consisting of a swimming pool, a room, a warehouse, an indicator, a road, a vehicle, a road sign, a billboard, a ship, a boat, an aircraft, a stadium, a tree, a window, and a lamppost having mounted therein or thereon at least one lighting device according to the present inventive subject matter.

The devices according to the present inventive subject matter can further comprise one or more long-life cooling device (e.g., a fan with an extremely high lifetime). Such long-life cooling device(s) can comprise piezoelectric or magnetorestrictive materials (e.g., MR, GMR, and/or HMR materials) that move air as a "Chinese fan". In cooling the devices according to the present inventive subject matter, typically only enough air to break the boundary layer is required to induce temperature drops of 10 to 15 degrees C. Hence, in such cases, strong "breezes" or a large fluid flow rate (large CFM) are typically not required (thereby avoiding the need for conventional fans).

In some embodiments according to the present inventive subject matter, any of the features, e.g., circuitry, as described in U.S. Patent Application No. 60/809,959, filed on Jun. 1, 2006, entitled "LIGHTING DEVICE WITH COOLING" (inventors: Thomas G. Coleman, Gerald H. Negley and Antony Paul van de Ven) and U.S. patent application Ser. No. 11/626,483, filed Jan. 24, 2007 (now U.S. Patent Publication No. 2007/0171145), the entireties of which are hereby incorporated by reference as if set forth in their entireties, can be employed.

The devices according to the present inventive subject matter can further comprise secondary optics to further change the projected nature of the emitted light. Such secondary optics are well-known to those skilled in the art, and so they do not need to be described in detail herein—any such secondary optics can, if desired, be employed.

The devices according to the present inventive subject matter can further comprise sensors or charging devices or cameras, etc. For example, persons of skill in the art are familiar with, and have ready access to, devices which detect one or more occurrence (e.g., motion detectors, which detect motion of an object or person), and which, in response to such detection, trigger illumination of a light, activation of a security camera, etc. As a representative example, a device according to the present inventive subject matter can include a lighting device according to the present inventive subject matter and a motion sensor, and can be constructed such that (1) while the light is illuminated, if the motion sensor detects movement, a security camera is activated to record visual data at or around the location of the detected motion, or (2) if the motion sensor detects movement, the light is illuminated to light the region near the location of the detected motion and the security camera is activated to record visual data at or around the location of the detected motion, etc.

The present inventive subject matter provides for improved overall system efficiency to provide a self ballasted lamp having a wall plug efficiency of at least 85 lumens for each watt of input power. The self ballasted lamp may be used for AC or DC operation. Each aspect of the lamp has been designed to improve efficiency and, in some cases, optimize efficiency for the overall system. This includes the power supply, thermal management, optic system, LED light sources and LED configuration. The inventive subject matter provides a lamp with a high CRI (>90) at a relatively warm CCT of less than 4000K.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

FIG. 1 is a schematic diagram of a high efficiency lamp 10 according to the inventive subject matter. The lamp 10 includes a lower housing 12 and an upper housing 14. The lower housing 12 is a cast aluminum housing having fins surrounding the circumference and provides sidewalls of the mixing enclosure 24. The lower housing may be a lower housing of an LR6 fixture from Cree LED Lighting Solutions, Inc., Durham, N.C., with the trim flange removed such that the housing does not extend past the lens 22. Other suitable lower housing materials having similar thermal properties could also be utilized.

The upper housing 14 includes a cavity 16 and also has fins to increase the overall area for heat extraction. The upper housing 14 has substantially the same configuration as the upper housing of the LR6 fixture. In the present embodiment, the upper housing 14 is made from copper. Other suitable upper housing materials having similar thermal properties could also be utilized. For example, the upper housing could be made from aluminum or other thermally conductive material. An electrically insulating layer 17 is provided within the upper housing 14 to isolate the power supply 34 from the upper housing 14. The insulating layer 17 may, for example, be Formex. A thermal gasket (not shown) is provided between the upper housing 14 and the lower housing 12 to assure a good thermal coupling between the two housings. The thermal gasket may, for example, be Sil-Pad from The Bergquist Company.

A top plate 18 is provided on the upper housing 14 and encloses the cavity 16. A connector 20, such as an Edison type screw connector, is provided on the top plate 18 to allow connection of the lamp 10 to a power source, such as an AC line. Other connector types could be utilized and may depend on the power source to which the lamp 10 is to be connected.

A lens 22 is provided on the opening of the lower housing 12 to provide a mixing enclosure 24 having sidewalls defined by the lower housing 12 and opposing ends formed by the upper housing 14 and the lens 22. The mixing enclosure 24 is a frusto-conical shape with a height of about 2.15" and with a diameter at one end of 2.91" and of 4.56" at the opposing end.

The lens 22 includes optical features on the side facing the light sources that obscures the light sources and mixes the light. The lens used in the present embodiment is a lens from the LR6 fixture that is provided by RPC Photonics, Rochester, N.Y. In general, the lens 22 has a full width, half max (FWHM) of between 50° and 60°, which balances light transmission with diffusion to obscure the light sources.

The mixing enclosure 24 is lined with a highly reflective material 26, such as MCPET® from Furakawa, to reduce losses from light reflected back into the mixing enclosure 24 by the lens. The highly reflective material 26 reflects between 98% and 99% of the light across the visible spectrum. A reflective material 27 is also provided on the LED board 28 and may be provided on any exposed portions of the upper housing 14. The reflective material 27 can also be MCPET®, laser cut to fit around the LEDs 30 and 32.

The light sources are LEDs. The LEDs include non-white, non-saturated phosphor converted LEDs 30 and saturated LEDs 32. The LEDs provided light output as described in U.S. Pat. No. 7,213,940, the entirety of which is hereby incorporated herein in its entirety. In this particular embodiment, 21 phosphor converted LEDs 30 and 11 saturated LEDs 32 are utilized. The phosphor converted LEDs 30 are Cree X Lamps from Cree, Inc., Durham, N.C. and the saturated LEDs 32 are from OSRAM/Sylvania. The brightness of the parts are sufficiently high to achieve the desired light output and wall plug efficiency. The saturated LEDs 32 are OSRAM Golden Dragon parts to which lenses are attached to improve light extraction. In particular, an optical adhesive is used to attach lenses, such as the lenses from Cree XRE parts, to the Golden Dragons.

The LEDs 30 and 32 are serially connected in a single string of LEDs. This provides a high voltage string of LEDs that allows for increased efficiency in driving the LEDs. The LEDs 30 and 32 are selected so as to provide the desired mixed color point. In particular, the LEDs are phosphor converted LEDs having color points that are close to a line between x,y coordinates of the 1931 CIE diagram of 0.3431, 0.3642; and 0.3625, 0.3979 and LEDs having color points that are close to a line between x,y coordinates of the 1931 CIE diagram of 0.3638, 0.4010; and 0.3844, 0.4400. The phosphor LEDs have outputs that range from 108.2 lumens to 112.6 lumens at 350 mA. The saturated LEDs have color points at x,y coordinates of the 1931 CIE diagram of about 0.6809, 0.3189 and a peak wavelength of about 622 nm.

The LEDs 30 and 32 are mounted on a copper metal core circuit board 28 which is mounted with a thermal gasket material 29 to the upper housing 14. A conformal coating (not shown) of HumiSeal 1C49LV is applied to the circuit board 28. The circuit board 28 is connected to the power supply 34 through the upper housing 14.

Figure 2:
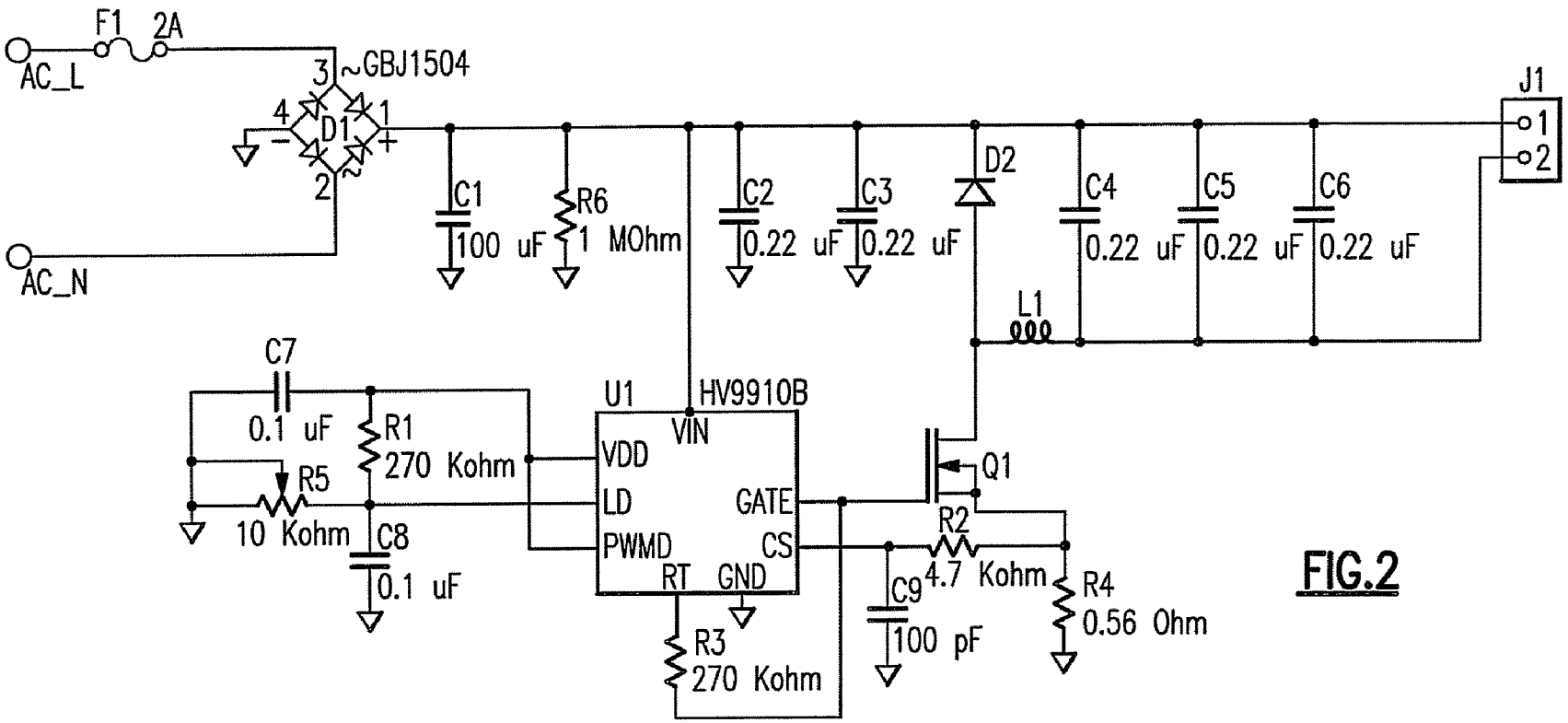
FIG. 2 is a schematic of the power supply in the embodiment depicted in FIG. 1.
Figure 3:
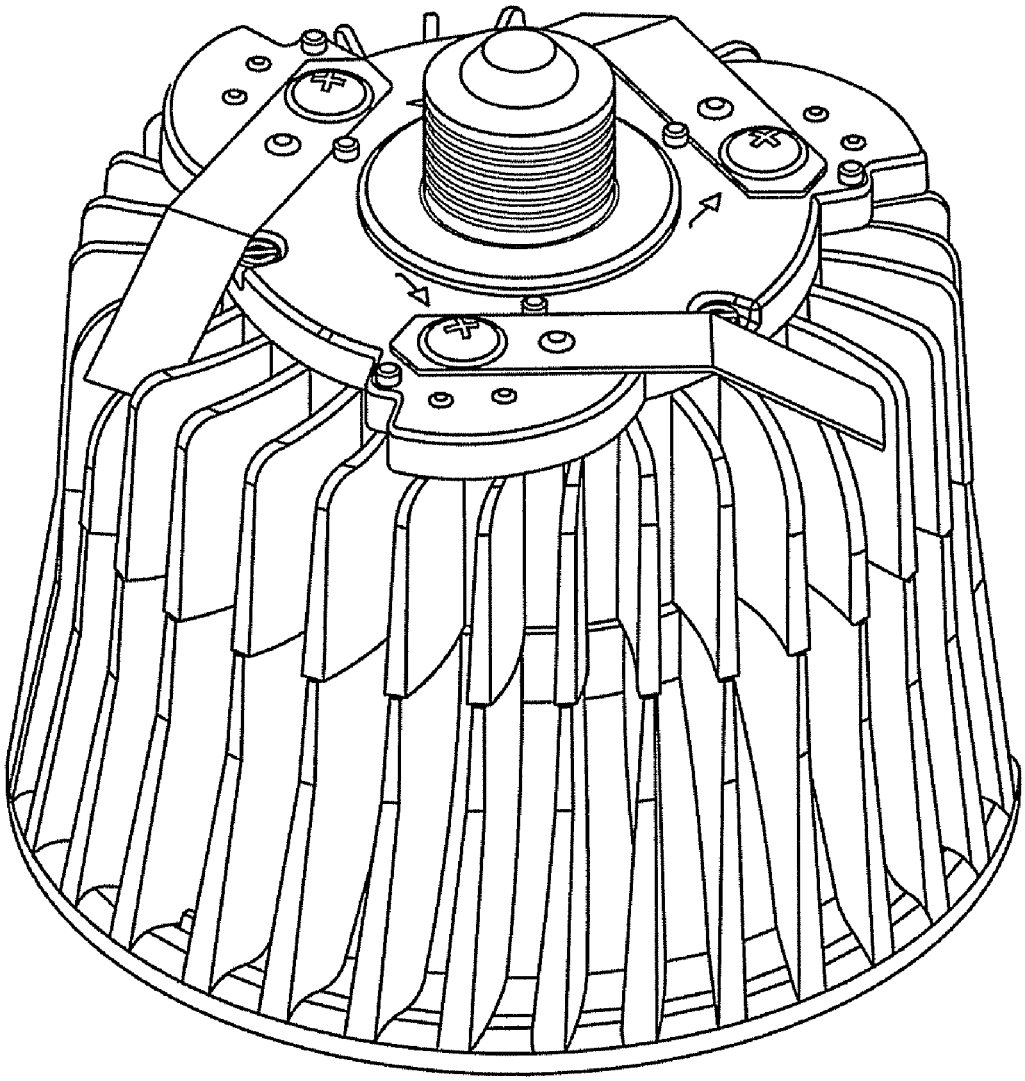
FIGS. 3-6 are pictures of an embodiment of a self-ballasted lamp in accordance with the present invention.
Figure 4:
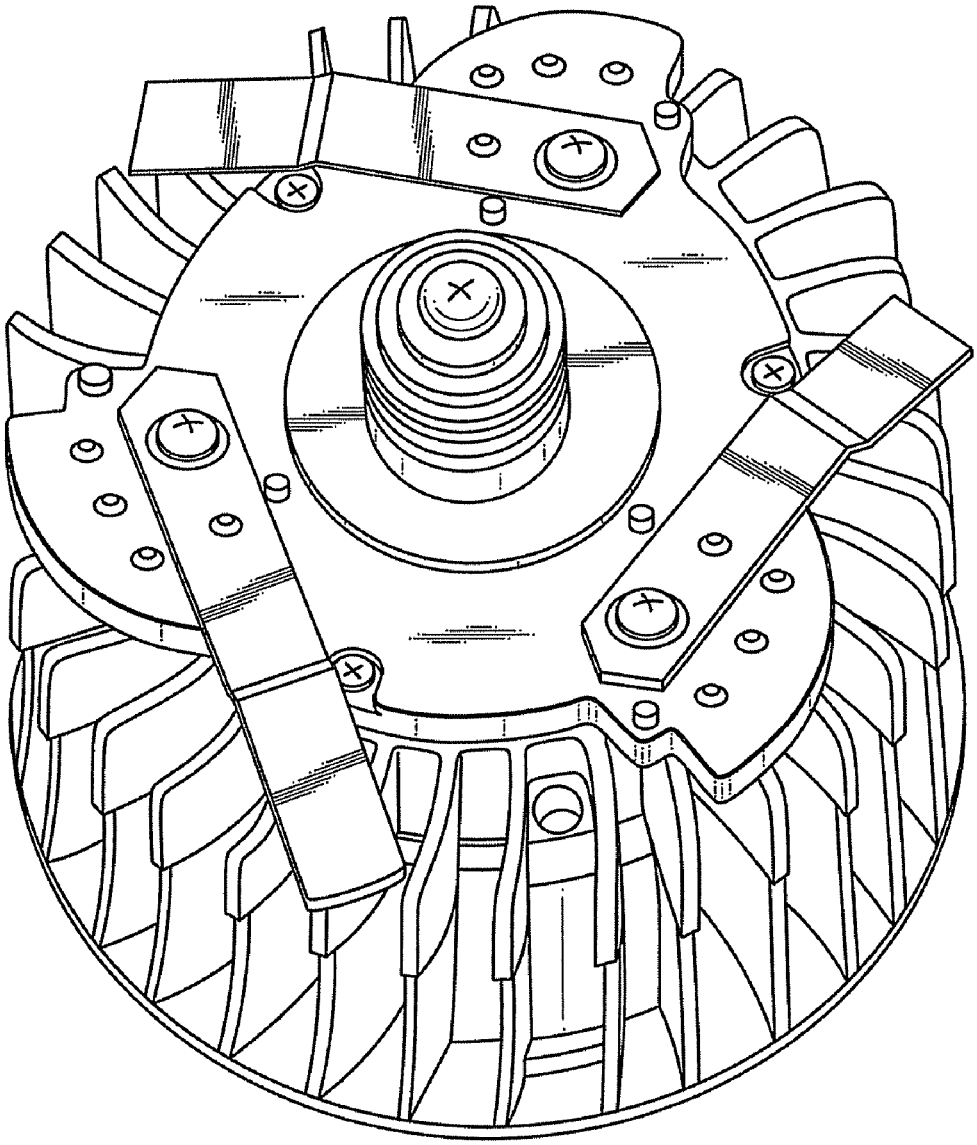
Figure 5:
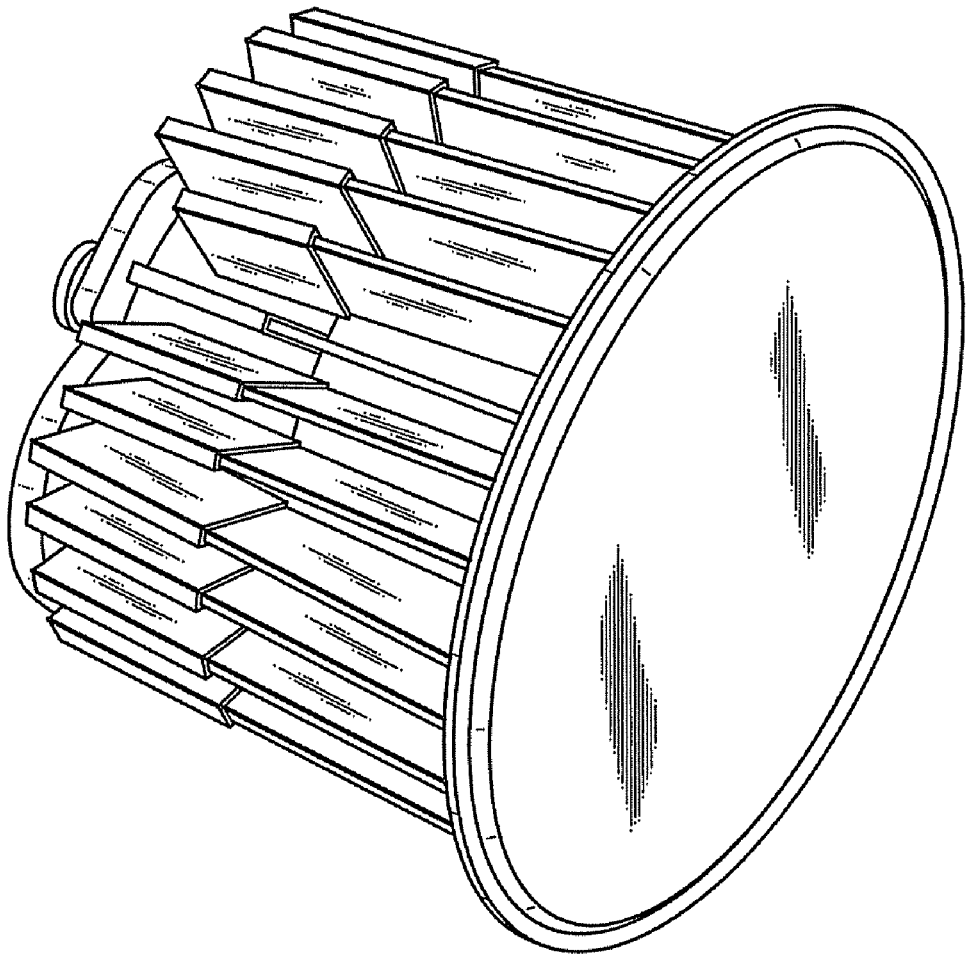
Figure 6:
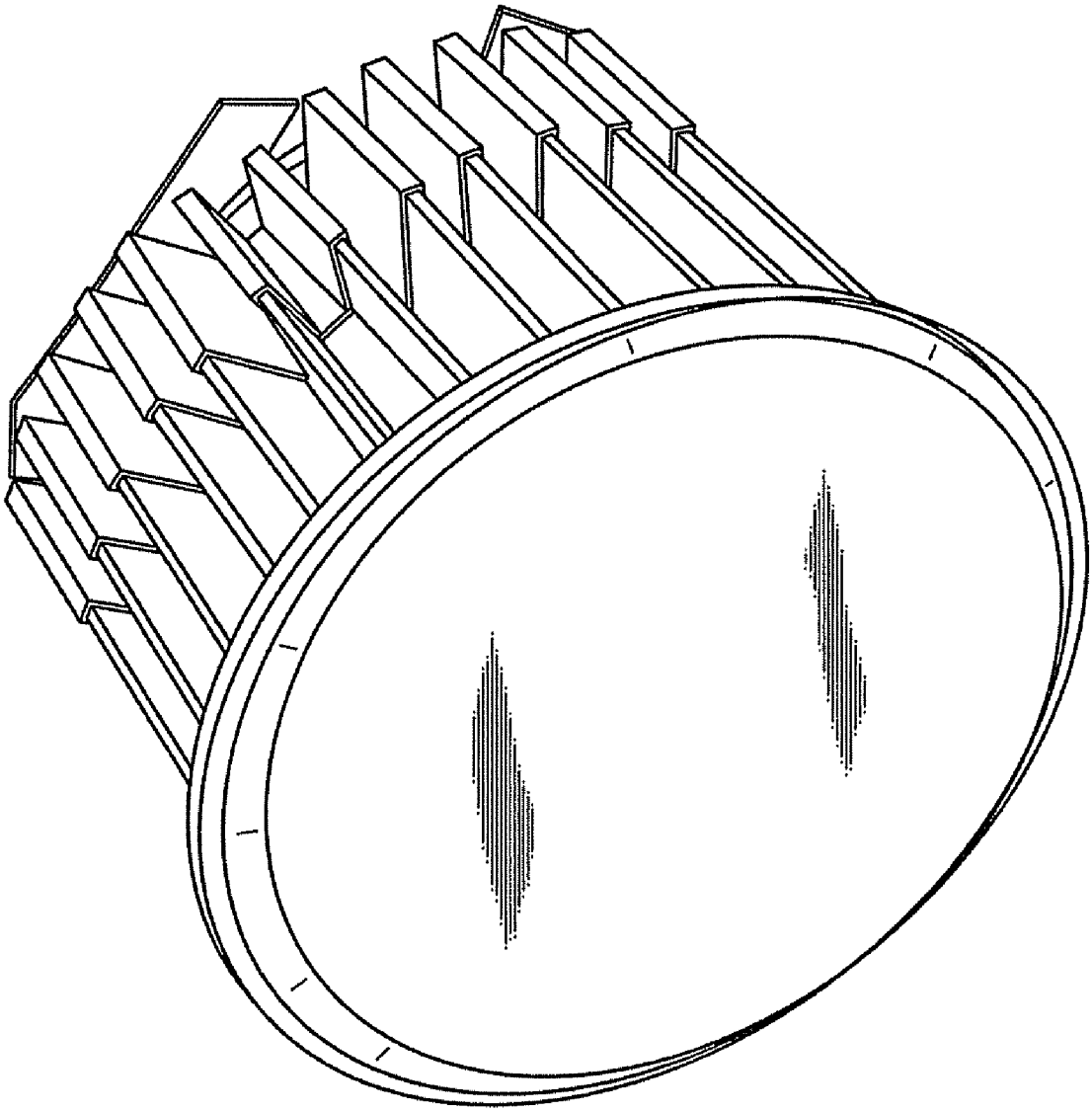

The power supply 34 is connected to the Edison connector 20 through wires 36 and 38. A schematic of the power supply 34 is provided in FIG. 2. In FIG. 2, the string of LEDs is connected between pins 1 and 2 of J1. With regard to specific parts, the values in the present embodiment are provided in FIG. 2 for the majority of parts. With regard to parts without values, the diode D2 is a MURS140 from Digikey, the inductor L1 is 3.9 mH and the transistor Q1 is an nFET FQP3N30-ND from Digikey. The HV9910B is a universal high brightness LED driver from Supertex, Inc, Sunnyvale, Calif. The variable resistance R5 is provided to adjust the current through the LED string connected across J1.

The device of FIGS. 1 and 2 was tested by NIST and resulted in the Following performance:

Input voltage: 120 Volts (V) AC, 60 Hz
Lamp current: 0.1158 Amperes (A)
LED Lamp Input Electrical Power: 5.802 Watts (W)
Total Luminous Flux: 658.7 lumens (lm)
Wall plug efficiency: 113.5 lm/W
CIE 1931 chromaticity coordinates: x 0.4511, y 0.4022
Correlated Color Temperature: 2760K
CRI: 91.2
Ambient temperature: 26° C.

The optical performance of the system was measured internally at LED Lighting Fixtures, Inc. (Morrisville, N.C.) as about a 4.5% loss in that about 95.5% of the light generated by the light sources was extracted from the lamp. The power supply efficiency was measured internally at LED Lighting Fixtures, Inc. as about 93.5% in that 93.5% of the power supplied to the lamp was supplied to the load.

Pictures of the self ballasted lamp are provided in FIGS. 3-6.

In light of the above discussion, solid state lighting lamps are provided that have a wall plug efficiency of at least 85 lm/W, in some embodiments at least 90 lm/W, in other embodiments at least 100 lm/W and in further embodiments at least 110 lm/W. Such lamps may have a CCT of less than about 4000K, in some embodiments about 3500K and in other embodiments about 2700K. Furthermore, the output lumens of such lamps may be 300 lumens or greater, in some embodiments, 500 lumens or greater, in further embodiments about 650 lumens and in additional embodiments greater than 650 lumens.

In particular embodiments, the solid state lighting lamp may be a self ballasted lamp and may include the power supply and light source. Additionally, in some embodiments, the thermal design of the lighting device is such that the junction temperature of the LEDs can be maintained at or below the manufactured rated junction temperature for a 25,000 hour lifetime, a 35,000 hour lifetime or even a 50,000 hour lifetime when operated in an ambient of 25° C. or less or in some embodiments 35° C. or less. Accordingly, in some embodiments the lighting device has an expected lifetime of 25,000 hours of operation, in other embodiments, 35,000 hours of operation and in further embodiments, 50,000 hours of operation.

In particular embodiments, the solid state lamps according to the present inventive subject matter receive AC power from an AC power line such that wall plug efficiency is delivered lumens per watt of AC input power.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary slill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which are held together, if necessary). Similarly, any two or more functions can be conducted simultaneously, and/or any function can be conducted in a series of steps.

The invention claimed is:

1. A lighting device comprising at least one solid state light emitter, said lighting device, when supplied with electricity of a first wattage, emitting output light having a wall plug efficiency of at least 85 lumens per watt of said electricity.

2. A lighting device as recited in claim 1, wherein said output light is of a brightness of at least 300 lumens.

3. A lighting device as recited in claim 1, wherein said output light is perceived as white.

4. A lighting device as recited in claim 1, wherein said output light has a CRI Ra of at least 90.

5. A lighting device as recited in claim 1, wherein said solid state light emitter is a first light emitting diode.

6. A lighting device as recited in claim , wherein said lighting device further comprises at least one luminescent material.

7. A lighting device as recited in claim 1, wherein said lighting device further comprises at least one power line, at least a first group of said light emitting diodes being directly or switchably electrically connected to said power line, a voltage drop across said first group of said light emitting diodes, and across any other components along said power line, being between 1.3 and 1.5 times a standard outlet voltage.

8. A lighting device as recited in claim 1, wherein when said lighting device is supplied with electricity of said first wattage, a mixture of all light exiting from said lighting device which was emitted by any of said at least one solid state light emitter which emit light having a dominant wavelength which is outside the range of between 600 nm and 700 nm would have x, y color coordinates which define a point which is within an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38.

9. A lighting device as recited in claim 1, wherein said output light is perceived as warm white.

10. A lighting device as recited in claim 1, wherein said lighting device, when supplied with electricity of a first wattage, emits output light having a wall plug efficiency in the range of from about 85 to about 113.5 lumens per watt of said electricity.

11. A lighting device as recited in claim 1, wherein said lighting device, when supplied with electricity of a first wattage, emits output light having a wall plug efficiency of at least 110 lumens per watt of said electricity.

12. A lighting device as recited in claim 1, wherein said lighting device, when supplied with electricity of a first wattage, emits output light having a wall plug efficiency in the range of from about 100 to about 113.5 lumens per watt of said electricity.

13. A lighting device as recited in claim 1, wherein said electricity is AC electricity.

14. A light device as recited in claim 1, wherein the lighting device comprises a self-ballasted lamp.

15. A lighting device as recited in claim 1, wherein the lighting device further maintains a junction temperature of the solid state light emitter at or below a manufacturer rated junction temperature for a 25,000 hour lifetime in a 25 ° C. ambient temperature.

16. A lighting device as recited in claim 1, wherein the lighting device comprises:

one or more strings of light emitting diodes;

a power supply for driving the one or more strings of light emitting diodes from an AC power source;

a heat sink in thermal communication with the light emitting diodes and configured to transfer heat from the light emitting diodes to an ambient environment of the lighting device; and a diffuser optic configured to balance light transmission with diffusion to obscure the light emitting diode light sources.

17. A method of lighting, comprising supplying electricity to a lighting device comprising at least one solid state light emitter, causing the lighting device to emit light at a wall plug efficiency of at least 85 lumens per watt of said electricity.

18. A method as recited in claim 17, wherein output light exiting from said lighting device is of a brightness of at least 300 lumens.

19. A method as recited in claim 17, wherein output light exiting from said lighting device is perceived as white.

20. A method as recited in claim 17, wherein output light exiting from said lighting device has a CRI Ra of at least 90.

21. A method as recited in claim 17, wherein said lighting device has a wall plug efficiency in the range of from about 85 to about 113.5 lumens per watt of said electricity.

22. A method as recited in claim 17, wherein said lighting device has a wall plug efficiency of at least 110 lumens per watt of said electricity.

23. A method as recited in claim 17, wherein said power is AC electricity.

24. A method of lighting, comprising:

providing a lighting device that uses power of a first wattage;

providing at least one solid state light emitter; and emitting light that has a wall plug efficiency of at least 85 lumens per watt of power.

25. A lighting device as recited in claim 1, wherein said lighting device, when supplied with electricity of a first wattage, emits output light having a wall plug efficiency in the range of from about 85 to about 100 lumens per watt of said electricity.

26. A lighting device as recited in claim 1, wherein said lighting device, when supplied with electricity of a first wattage, emits output light having a wall plug efficiency in the range of from about 85 to about 110 lumens per watt of said electricity.

* * * * *

UNITED STATES PATENT AND TRADEMARK OFFICE

CERTIFICATE OF CORRECTION

PATENT NO. : 8,403,531 B2
APPLICATION NO. : 12/277745
DATED : March 26, 2013
INVENTOR(S) : Gerald H. Negley et al.

It is certified that error appears in the above-identified patent and that said Letters Patent is hereby corrected as shown below:

In the Specifications:

Column 11, lines 65-66
Please change: "(now U.S. Patent Publication No. 2008/084685)" to -- (now U.S. Patent Publication No. 2008/0084685) --

In the Claims:

Column 23, line 23
Claim 6: please add "1" after "claim"

Signed and Sealed this
Eleventh Day of June, 2013

Teresa Stanek Rea
*Acting Director of the United States Patent and Trademark Office*